US005232307A

United States Patent [19]

Nouri

[11] Patent Number: 5,232,307

[45] Date of Patent: Aug. 3, 1993

[54] HYDRAULIC OSCILLATING DIVERTER

[76] Inventor: Hasan M. Nouri, 29092 Dean St., Laguna Niguel, Calif. 92677

[21] Appl. No.: 743,109

[22] Filed: Aug. 9, 1991

[51] Int. Cl.[5] ..... E02B 11/00

[52] U.S. Cl. ..... 405/36; 405/37; 405/80; 137/861; 138/103; 138/178

[58] Field of Search ..... 405/52, 53, 74, 80, 405/36, 37, 39, 40, 51; 137/561 R, 861; 138/37, 103, 106, 107, 178; 210/456, 519

[56] References Cited

U.S. PATENT DOCUMENTS

| | | | |
|---|---|---|---|
| 921,513 | 5/1909 | Crawford | 405/36 |
| 1,843,799 | 2/1932 | Blatter | 405/36 |
| 2,271,480 | 1/1942 | Gibson et al. | 137/861 X |
| 3,575,004 | 4/1971 | Gachne et al. | 405/36 X |
| 4,431,338 | 2/1984 | Hornabrook | 405/37 |
| 4,457,646 | 7/1984 | Laesch | 405/36 X |
| 4,522,534 | 6/1985 | Wakamori et al. | 405/37 |

FOREIGN PATENT DOCUMENTS

| | | | |
|---|---|---|---|
| 32086 | 7/1981 | European Pat. Off. | 405/80 |
| 3634552 | 4/1988 | Fed. Rep. of Germany | 405/36 |
| 2120 | 1/1980 | Japan | 405/37 |
| 77178 | 5/1984 | Japan | 137/861 |
| 847286 | 7/1981 | U.S.S.R. | 405/39 |
| 859561 | 9/1981 | U.S.S.R. | 137/861 |
| 971999 | 11/1982 | U.S.S.R. | 405/36 |
| 1161643 | 6/1985 | U.S.S.R. | 405/39 |
| 1214830 | 2/1986 | U.S.S.R. | 405/80 |

OTHER PUBLICATIONS

Stahre, Peter et al., Storm-Water Detention for Drainage, Water Quality and CSO Management, Chapters, 11-14, pp. 138-190, Prentice-Hall, 1990.

*Primary Examiner*—Dennis L. Taylor
*Assistant Examiner*—John Ricci
*Attorney, Agent, or Firm*—Knobbe, Martens, Olson & Bear

[57] ABSTRACT

A hydraulic diverter comprises a pair of tubes connected to receive water from a storm drain. One of the tubes is connected to discharge the water into a basin, while the other is connected to discharge water and bed sediment load into a bypass line. The storm water flow is preferentially directed through one tube or the other by changing the relative elevations of the tubes. The tubes are coupled together to change elevations by a pulley system or a swivel system. The pollutant laden "first flush" flow of storm water is diverted to the basin, while subsequent or "sustained" flow transporting bed sediment load is directed through the bypass line. The storm water itself is utilized to change the relative elevations of the tubes when the storm water flow transitions from a first flush flow to a sustained flow.

33 Claims, 7 Drawing Sheets

HYDRAULIC OSCILLATING DIVERTER

FIELD OF THE INVENTION

The present invention relates to the control and management of storm water and urban runoff in urban communities.

BACKGROUND OF THE INVENTION

The physical behavior and health of an alluvial stream depends on the extent of man's interference in its tributary areas. In its natural setting, a stream provides three main functions of: (1) allowing the conveyance of flood waters and drainage; (2) permitting the transportation of bed load, as well as suspended sediment load; and (3) assimilating some of the pollutants generated in its tributary areas. When a development is completed in a watershed which discharges to a stream, peak flood discharges and pollutant levels will be increased, while sediment yield will be reduced. If these increases and reduction are beyond the tolerance limit of the stream, it will be subjected to environmental and economic damages.

In order to prevent these damages, the following objectives must be achieved:

1. Reduce the peak flood discharge in order to prevent flooding along the downstream channels and to achieve a balance between water discharge and bed load discharge.

2. Allow the delivery of bed load (sand and gravel) contributed by the upstream watershed, thereby minimizing potential erosion and degradation along the downstream alluvial channel.

3. Minimize the discharge of pollutants to the downstream reach in order to preserve its biological, environmental and recreational values.

In the past, the general belief was that erosion and degradation of alluvial channels occur because of increases in peak discharge caused by the upstream development. Most cities and counties have adopted the popular drainage ordinance that states "Post-development discharges must not exceed the pre-development or natural discharges." This requirement is usually satisfied by constructing a local or regional detention basin. The term "detention" means holding excess flood water for a time in order to control the rate of flow to the downstream channel. Detention periods for basins located downstream of small watersheds (less than 100 acres) are usually a few hours and sometimes fractions of an hour.

In addition to controlling flood flows, conventional detention basins have provided retention of polluted water. The term "retention" means storing urban runoff that is of poor quality. Generally, the period of retention corresponds to several days or weeks until the retained water infiltrates to the ground or is lost through evaporation. If the retention basin is provided with an efficient filter system, the filtered water can be directly passed to the downstream reaches.

Frequently, conventional detention basins fail to achieve the objectives mentioned for the following reasons:

1. These basins not only retard floodwaters and capture pollutants, unfortunately they also trap the bed load so that none of it will reach the downstream alluvial channel. Even though the discharge may be reduced significantly, supply of inadequate quantities of bed load may cause erosion along the downstream reach.

2. In general, pollutants are adsorbed to the suspended load particles and not to the bed load particles. During the occurrence of a significant storm event when the overflow system of the basin becomes operational, some of the suspended load particles, and therefore pollutants, would escape from the basin.

3. Environmental constraints and costs make it difficult to locate suitable disposal sites for the accumulated sediments in the basin. In many city and county jurisdictions, sediment deposits are not removed for many years. The longer the deposits are kept in a basin, the less the storage capacity. This would reduce its detention capability, as well as its efficiency to capture suspended load particles. These poorly maintained basins not only continue to trap bed load, their design objectives, i.e., reduction in peak discharge and capture of pollutants, are not fulfilled.

4. Failure of basins to satisfy their objectives causes the downstream channels to generally show evidence of degradation. To prevent damage to structures and loss of property, the alluvial channel located downstream from a basin is paved or armored. This means loss of riparian habitat, which is no longer acceptable to our ecologically conscious society.

During construction periods, excessive sediment yield and delivery are usually controlled by constructing desilting basins. Frequently, those basins have inadequate sizes, permitting excessive discharge of suspended load which can be harmful to the downstream riparian habitat. Often, too many small desilting basins with little detention capability and efficiency to trap suspended sediments are constructed. Unfortunately, these basins trap most of the bed load. The combination of lack of attenuation and trapping significant quantities of bed load occasionally cause erosion along the alluvial reaches located downstream from the construction site. Fortunately, construction periods are short and channel degradation is a relatively slow process. During construction periods, usually the problems are reverse, i.e., common occurrence of aggradation as a result of excessive discharge of sediment loads to the downstream channels.

SUMMARY OF THE INVENTION

The present invention addresses the foregoing problems by utilizing a hydraulic diverter to control the flow of runoff, particularly storm water from a storm. If the dry period preceding the storm is prolonged, the early portion of storm flow, which is termed as the "first flush," has a relatively high concentration of pollutants. The remaining portion of the storm flow which has the majority of the volume is relatively free of pollutants and is sustained. The diverter comprises an inlet, a first outlet section, and a second outlet section. Each of the outlet sections is connected to receive storm water from the inlet for discharging storm water from the diverter. The diverter has two operational states and is configured to utilize energy of the storm water to change operational states, such that first flush flow is discharged through the first outlet section in a first operational state, and sustained flow is discharged through the second outlet section in a second operational state.

In the preferred embodiment, one of the outlet sections has a container disposed thereon to receive and store storm water and provide potential energy for changing operational states. The diverter changes from the first operational state to the second operational state when the potential energy reaches a threshold level.

Preferably, the inlet and outlet sections are comprised of tubes, one of which is elevated relative to the other. In one embodiment, the tubes are articulated and are coupled together by means of a line and a pulley. In alternative embodiments, the tubes are rigid, and are coupled together by a swivel arrangement.

The diverter of the preferred embodiment also receives storm water which has a relatively pollution free peak flow. This peak flow is discharged through the first outlet when the diverter is in the second operational state. In addition, the diverter may receive a nuisance flow of water that has a relatively high concentration of pollutants. The diverter is configured to discharge the nuisance flow through the first outlet section when the diverter is in the first operational state.

In accordance with another aspect of the invention, a storm water pollution control device comprises an inlet for receiving storm water, a first outlet section for discharging storm water having a relatively high concentration of pollutants, and a second outlet section for discharging storm water having a relatively low concentration of pollutants. The device further comprises means for (1) elevating at least a portion of the second outlet section relative to the first outlet section to inhibit flow of storm water through the second section, and (2) elevating at least a portion of the first outlet section relative to the second outlet section to inhibit flow of storm water through the first outlet section.

A further aspect of the invention relates to a hydraulic diverter for controlling runoff. The hydraulic diverter comprises a first tube which provides a first path for water received by the diverter, and a second tube which provides a second path for water received by the diverter. Flow control means preferentially directs water through the first path during a first period of time, utilizes water introduced into the diverter during the first period of time to provide energy for controlling the flow of water through the diverter, and utilizes the energy to alter the flow of water through the diverter such that at least a substantial portion of the water flows through the second path during the second period of time.

Another aspect of the invention comprises a drainage control system having a water retention/detention basin and a storm drain. The system diverts first flush flow produced by the storm from the storm drain to the basin. Sustained flow produced the storm is diverted, together with coarse sediment, to a bypass line connected to an outflow drain line, such that the sustained flow bypasses the basin. Peak flow produced by the storm is diverted to the basin for storage, and the water stored in the basin as peak flow is then discharged into the outflow line.

The invention also encompasses a method of controlling runoff, which comprises the step of introducing water into a diverter having first and second water paths. Water is preferentially directed through the first path during a first period of time, and that water is utilized to provide energy for controlling the flow of water through the diverter. The energy is utilized to control the flow of water through the diverter for a second period of time such that at least a substantial portion of the water flows through the second path during the second period of time.

In accordance with another aspect of the invention, a method of controlling pollution comprises the step of directing relatively low flows of storm water along a first path from an inlet to a first outlet. Relatively high flows of storm water are directed along a second path from the inlet to a second outlet. The flow of storm water is controlled by changing the relative elevations of the first and second paths.

DETAILED DESCRIPTION OF THE PREFERRED EMBODIMENT

Figure 1:
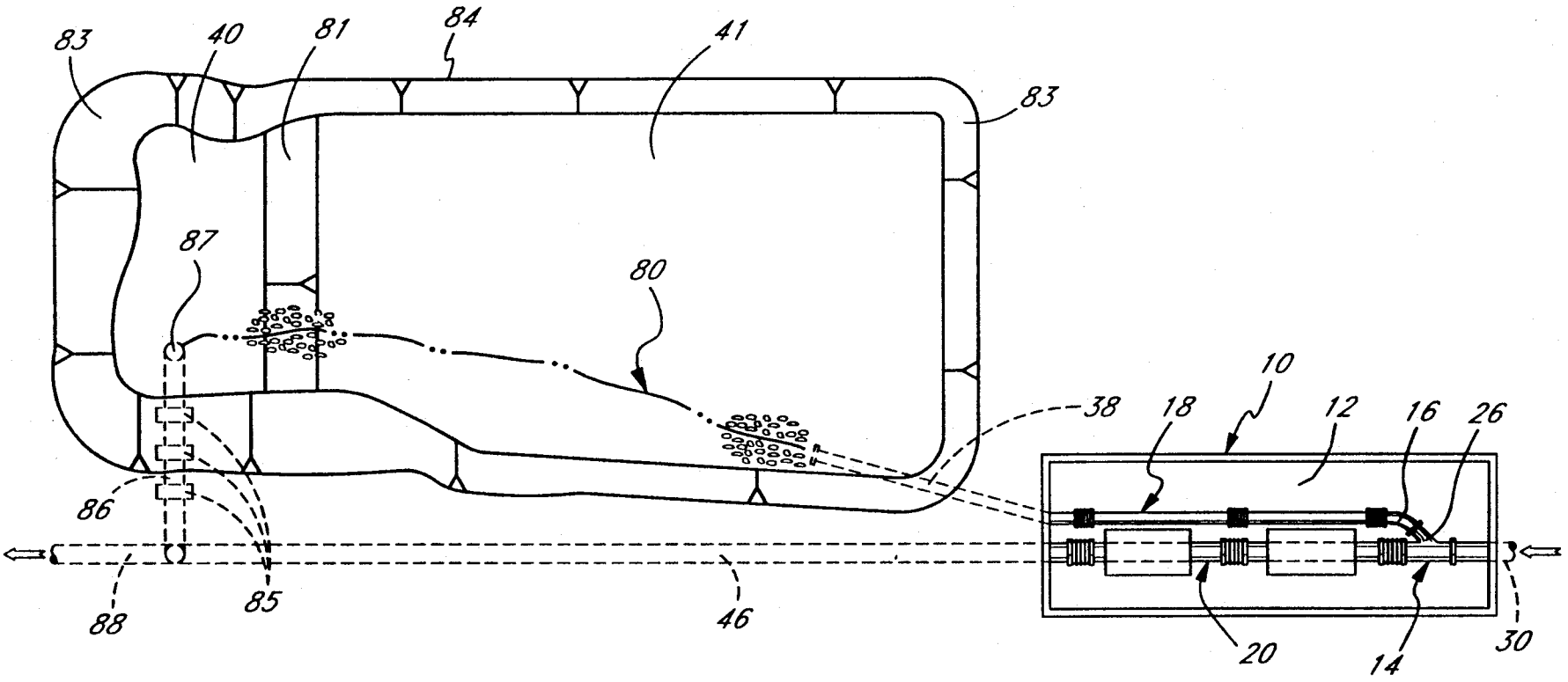
FIG. 1 is a top view of the invention as it is installed near an existing retention/detention basin.

Referring to FIG. 1, the present invention comprises a hydraulic oscillating diverter 10 that rests on a concrete base 12. The diverter 10 is connected to receive water from an existing inflow storm drain 30 and to discharge water into both an outlet pipe 38 and a bypass line 46, both of which allow the water to reach an outflow storm drain 88. The bypass line 46 is connected to convey water and sediment from the diverter 10 to the outflow storm drain 88 which leads to a channel within a downstream watershed outlet. The outlet pipe 38 discharges water into a water basin 84 which comprises a retention area 40 and a detention area 41, which are separated by a slope 81. Both areas 40 and 41 contain vegetation and are surrounded on all sides by detention banks 83. The detention banks 83 must be high enough to cause excess flood water to be held in the basin 84, at a level above the higher basin level. The retention area 40 is at a lower elevation than the detention area 41 and contains a drain 87 which collects water from the area 40. The opening of the drain 87 is not at ground level but is elevated so that the area 40 must fill to a predetermined height with water before the water begins to drain from the area. A drainage pipe 86 is located underground and is connected to receive water from the drain 87 and convey it to the outflow storm drain 88. The drainage pipe 86 also has seepage collars 85 to inhibit failure of the detention banks 83.

Figure 2:
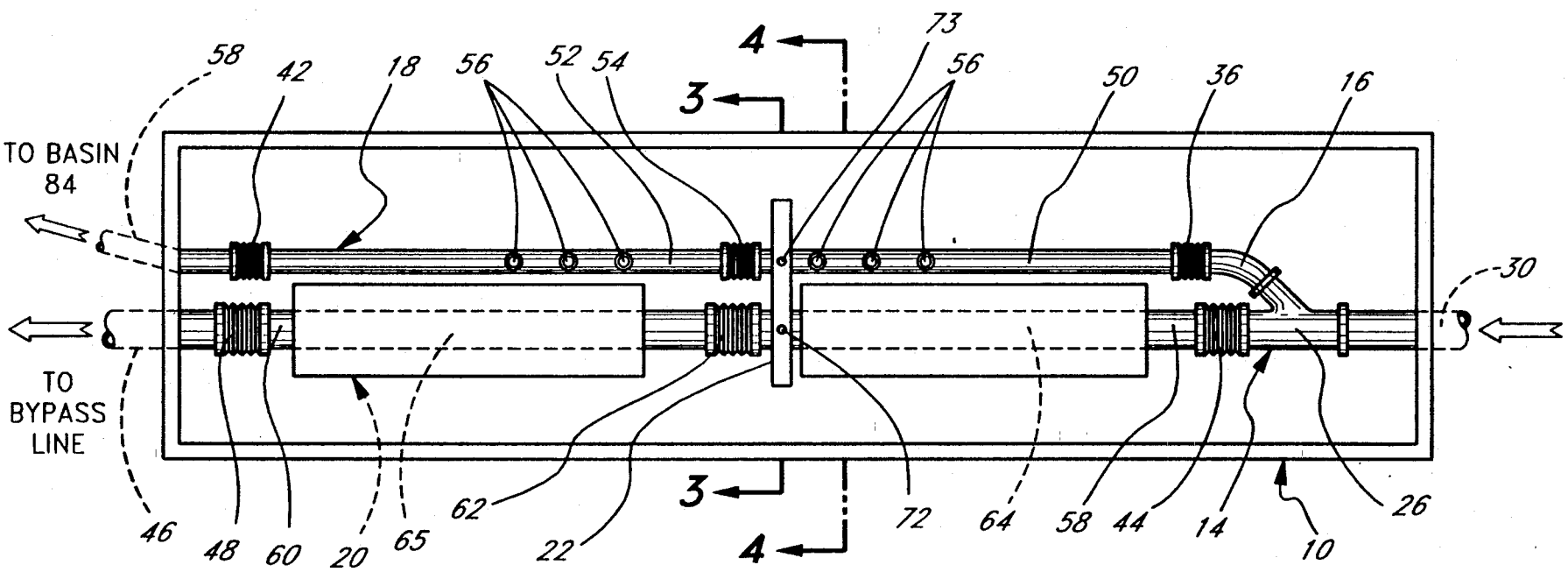
FIG. 2 is a top view of the one embodiment of the invention.

The diverter 10, shown in FIG. 2, comprises an inlet section 14, a diverter outlet section 18, a bypass outlet section 20, a guide block 22, and a pulley system 24. The inlet section comprises a Y-pipe 26 having an inlet which is connected to the outlet of the storm drain 30. The Y-pipe 26 also has two outlets which are connected to inlets of the two outlet sections 18 and 20 so as to allow water to flow from the storm drain 30 into either of the two outlet sections 18 and 20. The diverter outlet section 18 is connected to the outlet pipe 38, and the bypass outlet section 20 is connected to the bypass line 46. The bypass outlet section 20, the bypass line 46, and the inflow storm drain 30 are of substantially the same diameter, which will be referred to as the diameter $d_1$. The diverter outlet section 18 and the outlet pipe 38 are also of substantially the same diameter, which will be referred to as the diameter $d_2$. The diameter $d_1$ is substantially larger than the diameter $d_2$.

The diverter outlet section 18 comprises a 45 degree elbow pipe 16 and an articulated tube comprising two rigid pipes 50 and 52. The elbow pipe 16 is connected to one outlet of the Y-pipe 26. The first rigid pipe 50 is connected to the elbow pipe 16 by a flexible coupling 36. The second rigid pipe 52 is connected to the first rigid pipe 50 and to the outlet pipe 38 by flexible couplings 54 and 42 respectively. The flexible couplings allow the connected rigid pipes 50 and 52 to bend with respect to one another. The rigid pipes 50 and 52 also have a set of removable weights 56 attached to them.

The bypass section 20 comprises an articulated tube having two rigid pipes 58 and 60. The first rigid pipe 58 is connected to the other outlet of the Y-pipe 26 by a flexible coupling 44. The second rigid pipe 60 is connected to the first rigid pipe 58 and to the bypass line 46 by flexible couplings 62 and 48 respectively. All of the flexible couplings 36, 42, 44, 48, 54, and 62 are functionally identical.

Figure 4:
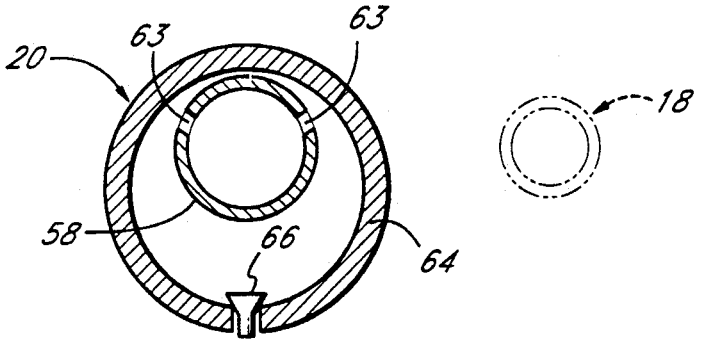
FIG. 4 is a cross sectional view taken along lines 4—4 in FIG. 2 showing the holding tank and drain in two operational states.
Figure 4:
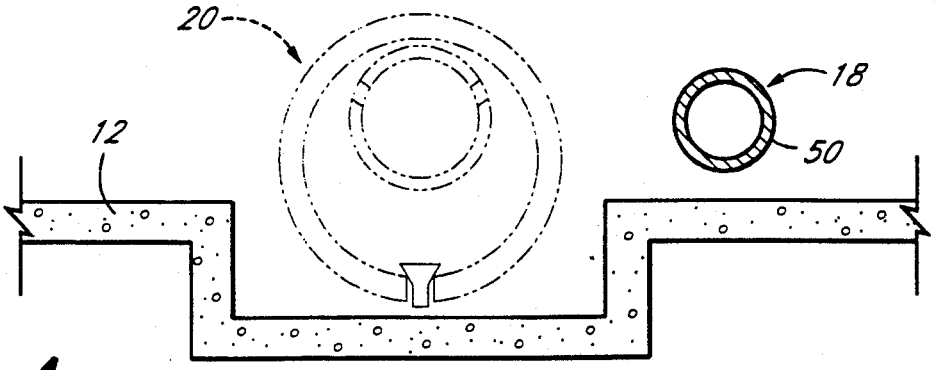

Referring to FIGS. 2 and 4, each of the rigid pipes 58 and 60 has weepholes 63 through which water can escape into a surrounding tank 64 and 65 respectively. Each tank 64 and 65 has a drain 66 at the bottom which can be opened and shut either directly or indirectly by an operator.

Figure 3:
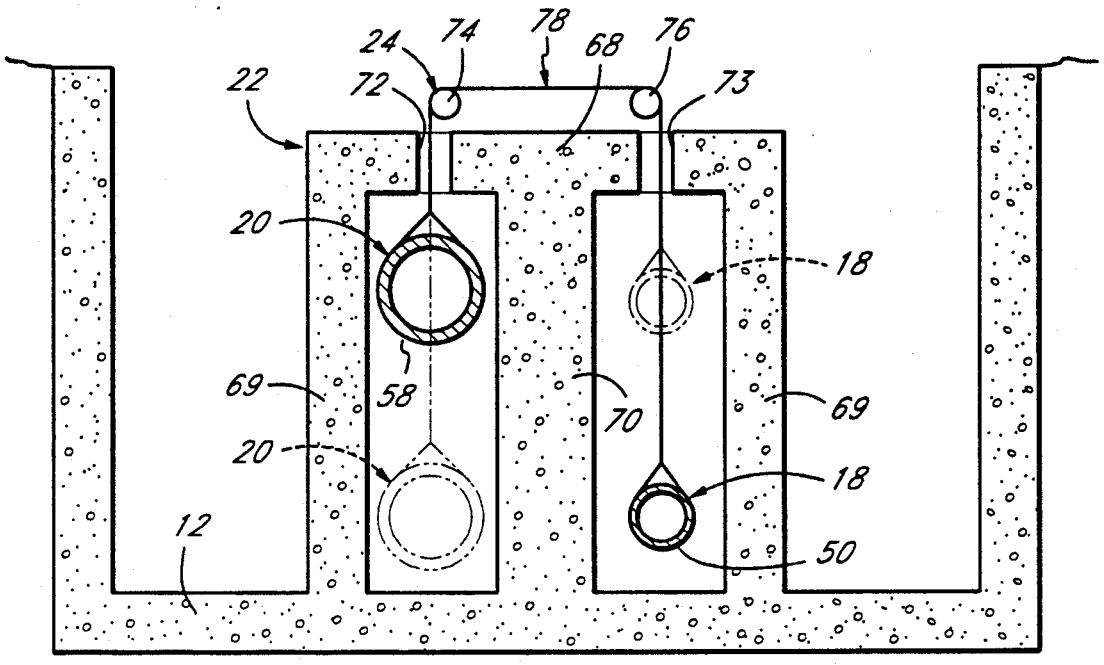
FIG. 3 is a cross sectional view taken along lines 3—3 of FIG. 2 showing articulated tubes in a guide block and a pulley system which allows the tubes to change positions.

The guide block 22, as shown in FIG. 3, comprises a single concrete structure, formed with the base 12, comprising a top post 68, two side supports 69, and a center support 70. The supports 69 and 70 rise vertically upward from the base 12 and form two slots between them in which the two outlet sections 18 and 20 are disposed. The top post 68 rests above the supports 69 and 70 and has two cable holes 72 and 73 which are located above the center of the slots between the supports 69 and 70. The entire guide block 22 is located along the outlet sections 18 and 20 between the center flexible couplings 54 and 62 and the tank 64 of the bypass section 20, both shown in FIG. 2.

Both the diverter section 18 and the bypass section 20 can be in one of two positions: the "down" position or the "up" position. In the down position, the pipe lays flat on the base 12 so that water can flow through it without being hindered by gravity. In the up position, the middle of the pipe is raised so that the two rigid sections of either pipe 18 or 20 slope upward toward the center. This prevents water from flowing through the raised pipe unless the pressure sufficient to push it over the slope. The flexible couplings are longitudinally stretchable in order to accommodate changes in the length of the outlet sections 18 or 20 when the sections move between the up and down positions. As shown in FIG. 3, the length of the side supports 69 of the guide block 22 is such that when either outlet section is in the up position, it is in proximity to but does not touch the top post 68.

The two outlet sections 18 and 20 are coupled together to move relative to one another by the pulley system 24 which comprises two pulleys 74 and 76 and a line or cable 78. Both pulleys 74 and 76 are supported by the top post 68 of the guide block 22. One end of the cable 78 is fastened to the rigid pipe 58 bypass section 20 and the other end is fastened to the rigid pipe 50 of the diverter section 18. The cable 78 travels from the rigid pipe 58 of the bypass section 20, up through the first cable hole 72 to the first pulley 74, across to the second pulley 76, and down through the second cable hole 73 to the rigid pipe 50 of the diverter section 18. The length of the cable 78 is such that when one of the outlet sections 18 or 20 is in the down position, the other section is in the up position. This provides for two states in which the diverter can operate: a diverting state and a bypassing state. In the diverting state, shown in solid lines in FIG. 3, the diverter section 18 is in the down position and the bypass section 20 is in the up position. In the bypassing state, shown in dashed lines, the reverse situation exists, that is, the bypass section 20 is in the down position and the diverter section 18 is in the up position.

The diverter 10, shown in FIGS. 1 and 2, functions to direct different types of water flow coming from an upstream watershed to appropriate locations. The types of flow are described below.

1. Nuisance Flow

Nuisance flow is a relatively low volume flow produced within a developed area by activities such as washing pavement surfaces and cars, running sprinkler systems, etc. Nuisance flow can also come from over-irrigating landscaped areas and from ruptured irrigation lines. Leakage from sanitary sewer lines and water supply pipes may be another source of nuisance flow. This low volume flow transports toxic substances such as pesticides and herbicides, petroleum waste products, and other chemicals through the storm drain system.

2. First Flush Flow

First flush flow is the initial storm water flow produced by a rain storm within a watershed. Storm water running off of roofs, streets, parking lots, lawns, landscaped and undeveloped areas finds its way to storm drain systems which convey the runoff through the storm drain system to the watershed outlet. If a storm occurs after a prolonged dry period, the water coming from the early part of the storm tends to flush out the accumulated pollutants in the watershed and is therefore characterized by a high concentration of pollutants. Urban runoff studies conducted on a variety of land uses in small watersheds have indicated that the first half inch of runoff contains 80 to 95 percent of the total annual loading of most storm water pollutants. Because of this, an entire storm can be considered first flush flow if it contributes less than one half inch of runoff.

3. Sustained Flow

Following the first flush flow, there will typically be a sustained flow of relatively pollution free water through the storm drain system, which carries a significant amount of bed load from the watershed to the downstream channel. The flow rate of sustained flow is higher than that of the first flush flow, but not so high that it causes or contributes to flooding in the downstream channel.

4. Peak Flow

During the height of an intense storm, the rate of flow of storm water may exceed the normal capacity of the watershed outlet and flooding occurs. This is especially common in a developed watershed because, as mentioned before, the impervious areas prevent water from being absorbed into the ground as in a natural watershed. When a flood situation occurs, the excess water flow above the level of the sustained flow is called peak flow. Peak flow must be temporarily stored in a detention basin and released gradually so that it does not contribute to flooding in the downstream channel.

In the initial state of the diverter 10 (shown in FIG. 2), both pipes 18 and 20 are empty, the drain valves 66 (shown in FIG. 4) are closed, and the weight of the dead weights 56 is sufficient to bias the diverter section 18 downwardly so that it is held in the down position, thereby causing the bypass section 20 to be held in the up position by the pulley system 24 (shown in FIG. 3), and thereby causing the entire diverter 10 to be in the diverting state.

For successful operation, flow through the inflow storm drain 30 should contain no large objects that could clog the system. This can be achieved by providing trash racks (not shown) within the upstream development areas at all catch basins and inlets for the storm drain system.

During normal dry periods, the upstream watershed contributes only a small volume of nuisance flow to the inflow storm drain 30. Referring to FIG. 1, nuisance flow enters the Y-pipe 26 and is preferentially directed through the diverter section 18 since the bypass pipe 20 is initially in the up position. The nuisance flow discharges to the detention area 41 and flows toward the retention area 40 along a riparian stream 80 which helps to filter the water by catching pollutant laden sediments. If the basin has no riparian stream 80, the nuisance flow can be discharged directly into the retention area 40.

The water discharged into the retention area 40 is stored and eventually is absorbed into the ground or evaporates over time. It does not escape through the drain 87 unless it exceeds the elevation of the top of the drain. Occasionally, the vertical drain 87 is perforated with a filter, allowing the release of filtered water into the drainage pipe 86. Any water reaching the elevation of the drain opening enters the drain 87 and then flows through drainage pipe 86 to bypass line 46. Any water further remaining is discharged into the outflow storm drain 88 and eventually reaches the downstream watershed outlet.

Figure 5:
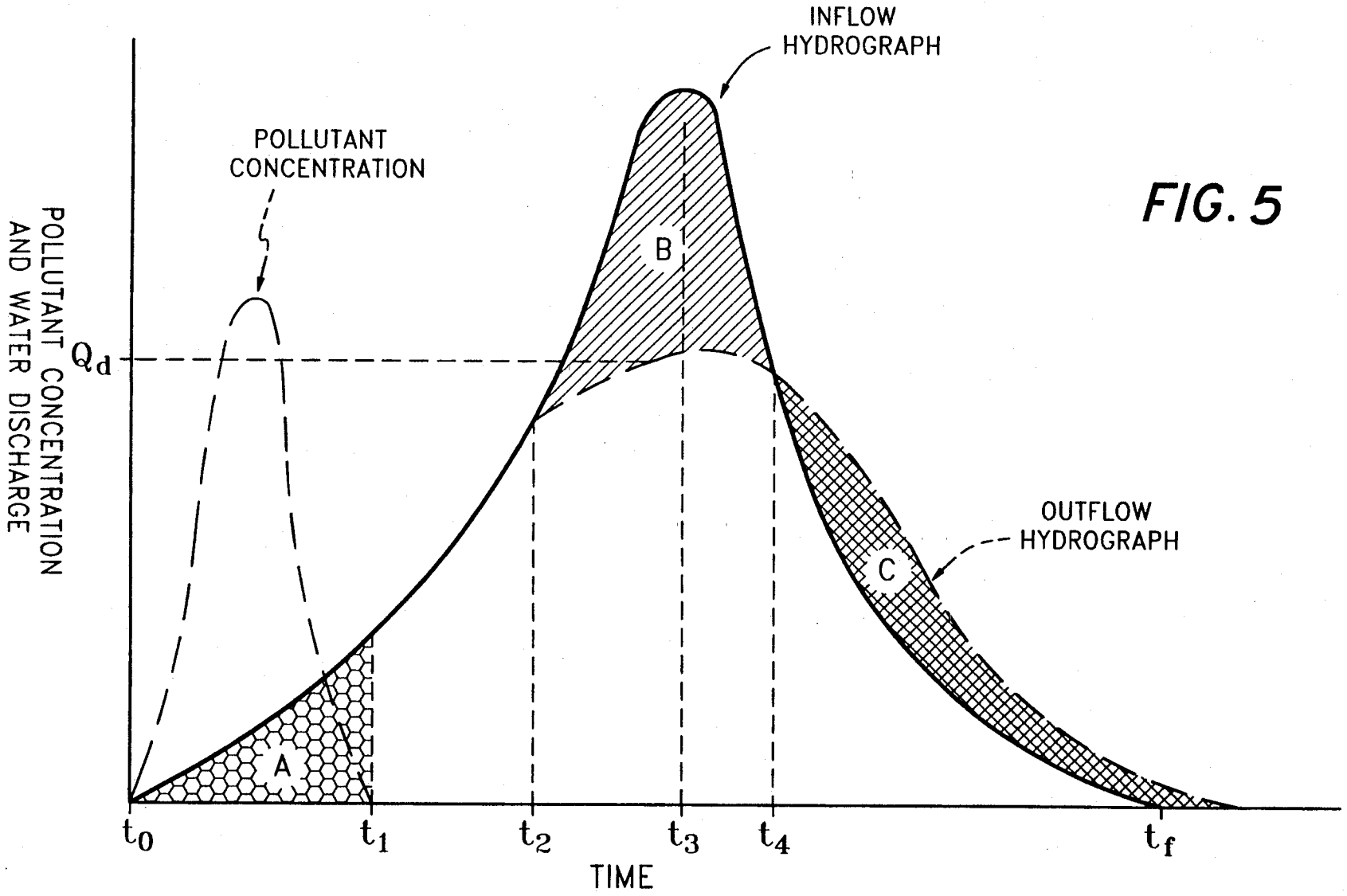
FIG. 5 is a graph showing the flow rate of water in units of volume per time flowing into and out of the system and the pollutant concentration in the water as a function of time.

FIG. 5 shows a graph representing an example of a typical "two year" storm (i.e., a storm of sufficient intensity such that it occurs once every two years on the average). Storm runoff from the watershed begins at time $t_0$ and ends at time $t_f$. The two solid curves labeled "inflow hydrograph" and "outflow hydrograph" represent the rate of flow in volume of water per unit time flowing into the system through storm drain 30 (FIG. 1) and flowing out of the system through storm drain 88 respectively. The dashed curve, labeled "pollutant concentration", illustrates the amount of pollutants in the water travelling through the inflow pipe 30 as a function of time.

The flow rate is determined by the amount of water upstream from the storm drain system. If the storm is of significant intensity, rainfall will collect in the watershed at a faster rate than can infiltrate into the ground. The more water waiting upstream to be drained, the greater will be the hydraulic pressure in the storm drain. Since the flow rate at any time depends on this pressure, it will increase during the first part of the storm as water collects upstream, peaking at time $t_3$ on the graph. At some time after time $t_3$, because the storm either decreases in intensity or stops altogether, the flow rate will begin to decrease as accumulated water is drained from the watershed.

After the storm begins at time $t_0$, the first flush flow volume, which is illustrated in the graph by the shaded area labeled area "A", enters through the storm drain 30 and is treated in the same manner as the nuisance flow. The first flush flow travels through the diverter section 18 and is inhibited from flowing through the bypass section 20 because the water pressure at the Y-pipe 26 is not yet sufficient to allow the water to travel up through the rigid pipe 58 (FIG. 2) when it is in the up position. Like the nuisance flow, the water that comprises the first flush flow, represented by the area A in FIG. 5, is discharged to the retention/detention basin 84 where pollutants contained in the first flush can then be removed by absorption into the earth or by a filtering system.

At the end of the first flush at time $t_1$, most of the pollutants have been removed from the watershed, but the flow rate from the storm continues to increase, as shown by the inflow hydrograph curve. As the flow transitions from a first flush flow to a relatively clean sustained flow, the increased amount of water upstream from the system causes the pressure to increase at the Y-Pipe 26 (shown in FIG. 2). This causes the water level in the rigid pipe 58 to rise. When the water level reaches the weepholes 63 shown in FIG. 4, water begins to enter into the first tank 64. As the water level continues to rise, it will eventually exceed the elevation of the center flexible connector 62 of the raised bypass section 20. When this occurs, flow is initiated through the rigid pipe 60 to the bypass line 46, and water will also enter into the second tank 65.

As the water stored in the tanks 64 and 65 increases, so does the potential energy of the entire bypass section 20 including the water. The extra water also increases the weight of the bypass section 20, which causes an increased upward force on the diverter section 18 by means of the pulley system 24 (FIG. 3). When the upward force on the diverter section 18 becomes sufficient to overcome the downward force caused by the weight of the dead weights 56, the diverter section 18 is pulled upwardly into the up position, allowing the bypass section 20 to descend by its own weight into the down position. In this way, the stored potential energy of the water is utilized to do work on the diverter in order to change its operational state.

The diverter will then be in the bypassing state shown in dashed lines in FIGS. 3 and 4. This causes the subsequent storm runoff comprising the sustained flow, illustrated by the unshaded area D in FIG. 5, to be directed through the bypass section 20 and into the bypass line 46. Since the bypass section 20 and bypass line 46 are of larger diameter than the diverter section 18, more water can now flow through the system. This causes the pressure at the Y-pipe 26 to be immediately reduced when the diverter 10 changes from the diverting state to the bypassing state. This reduction in pressure prevents water from flowing through the diverter section immediately after time $t_1$. Sediment carried by the storm water is thereby transferred directly to the downstream channel without collecting in the basin 84.

The flow volume of the first flush may be different for different locations or may change over the years in the same location due to further development in the watershed or other factors. This variation can be compensated for by varying the dead weights 56 on the diverter pipe 18. The heavier the diverter pipe 18, the greater the energy required to move the bypass pipe 20 downward, and the longer the diverter will stay in the diverting state, increasing the volume of first flush diverted to the basin 84.

During the period between $t_1$ and $t_f$, discharge is relatively clean and may be bypassed through the bypass outlet section 20, carrying with it the bed load sediment. As the storm continues, the amount of water needing to be drained by the storm drain system increases. This causes the pressure at the Y-pipe 26 to further increase, causing the water level to rise in the rigid pipe 50 of the diverter section 18. The additional pressure also causes the flow rate through the bypass section 20 to increase as shown in FIG. 5 between time $t_1$ and time $t_2$.

At time $t_2$, the water level in the pipe 50 will exceed the elevation of the center flexible coupling 54 and flow will initiate through the diverter section 18. Between time $t_2$ and time $t_4$, the excess peak flow volume, represented by the shaded area B in FIG. 5, will flow through the diverter section 18 and into the retention/detention basin 84 (FIG. 1) for storage. Thus, the downstream channel is protected from flooding. The peak flow directed to the basin 84 will contain virtually no bed load since it has traveled upward through the diverter section 18. The heavier bed load will instead be conveyed through the bypass section 20 to the downstream channel as desired and not collect in the basin 84.

As the basin 84 fills with storm water, the level of the water in the retention area 40 will eventually exceed the elevation of the drain 87 and begin to escape from the basin 84 through the drain pipe 86. The water level will continue to rise, usually exceeding the elevation of the detention area 41. The water escaping through the pipe 86, represented by the area C in FIG. 5, is then discharged a relatively slow rate into the outflow storm drain 88. At time $t_3$, the pressure at the Y-pipe 26 will decrease below the level needed to cause the water to flow through the raised diverter section 18. All water then continues to flow through the bypass pipe 20 as desired, since neither retention nor detention are required at this time.

The bypass section 20 will continue to remain in the down position due to the hydraulic weight in the tanks 64 and 65 until the water is somehow released. For a period of time after the storm, flow from the watershed remains relatively clean and requires no retention. Therefore, this flow can also bypass the water basin 84 preventing unnecessary overloading of the basin. After the end of the storm and before the occurrence of subsequent nuisance flow, the tanks 64 and 65 are preferably drained by means of the drain valves 66. Once the tanks 64 are drained, the weight of the dead weights 56 on the diverter section 18 will again be sufficient to overcome the weight of the bypass section 20 and the diverter 10 will return to the diverting state. The cycle will then be repeated again for the next storm.

The ratio of bed load transport to water discharge is an important factor in maintaining the stability of the downstream channel by preventing both erosion and accumulation of sediment. This ratio can be altered with the hydraulic oscillating diverter 10 by changing the length of the cable 78 shown in FIG. 3. If the cable 78 is lengthened, the elevation of the coupling 54 of the diverter section 18 when it is in the bypass state (dashed lines) will be reduced. If the coupling 54 is lower, peak flow, represented by the area B in FIG. 5, will initiate in the lowering the peak flow level $Q_d$ in FIG. 5. If more of the peak flow is diverted through diverter section 18, less water will flow through the bypass section 20. However, the amount of bed load sediment flowing through bypass section 20 will remain the same, thereby increasing the ratio of bed load transport to water discharge into the downstream channel.

As the ratio of bed load transport to water discharge increases, the tendency for the alluvial channel to degrade reduces. The maximum length of cable 78 should be limited, however, to prevent delivery of bed load through the diverter section 18 and into the detention basin. Once the diverter 10 is in operation, its performance should be monitored in the field. Depending on the alluvial behavior of the downstream reach observed in the field, final adjustment to the length of cable 78 can be made. It should be noted that adjusting the length of the cable will necessarily cause a change in the time of transition $t_1$ from a first flush flow regime to a sustained flow regime as well as the sustained flow level $Q_3$. However, such a change can be readily compensated for by altering the number of dead weights 56 on the diverter section 18.

In general, alluvial problems during construction of a development are temporary and different from long range problems. During construction periods disturbed watersheds produce significantly higher levels of sediment load than they would during their undisturbed condition. If preventive measures are not taken these higher levels of sediment load may damage the riparian habitat values as well as reduce the capacity of the downstream channel.

The hydraulic oscillating diverter 10 can also be used in conjunction with the retention/detention basin 84 to reduce the increased level of sediment yield when a portion of the watershed experiences significant construction activity. Care must be taken not to overload the diverter 10 with sediment, otherwise the system may become clogged. This can be achieved by constructing temporary desilting basins at or immediately downstream from the construction sites to catch sediment before it reaches the diverter 10. But the desilting basins, as explained previously, cannot usually handle all of the excess sediment, so that the amount of sediment reaching the diverter will still exceed normal levels. In order to protect the downstream channel from aggradation, the bypass section 20 may be temporarily plugged and all runoff containing suspended and bed sediment load should be diverted to the retention/detention basin 84, where it can later be removed when construction is completed.

Figure 6:
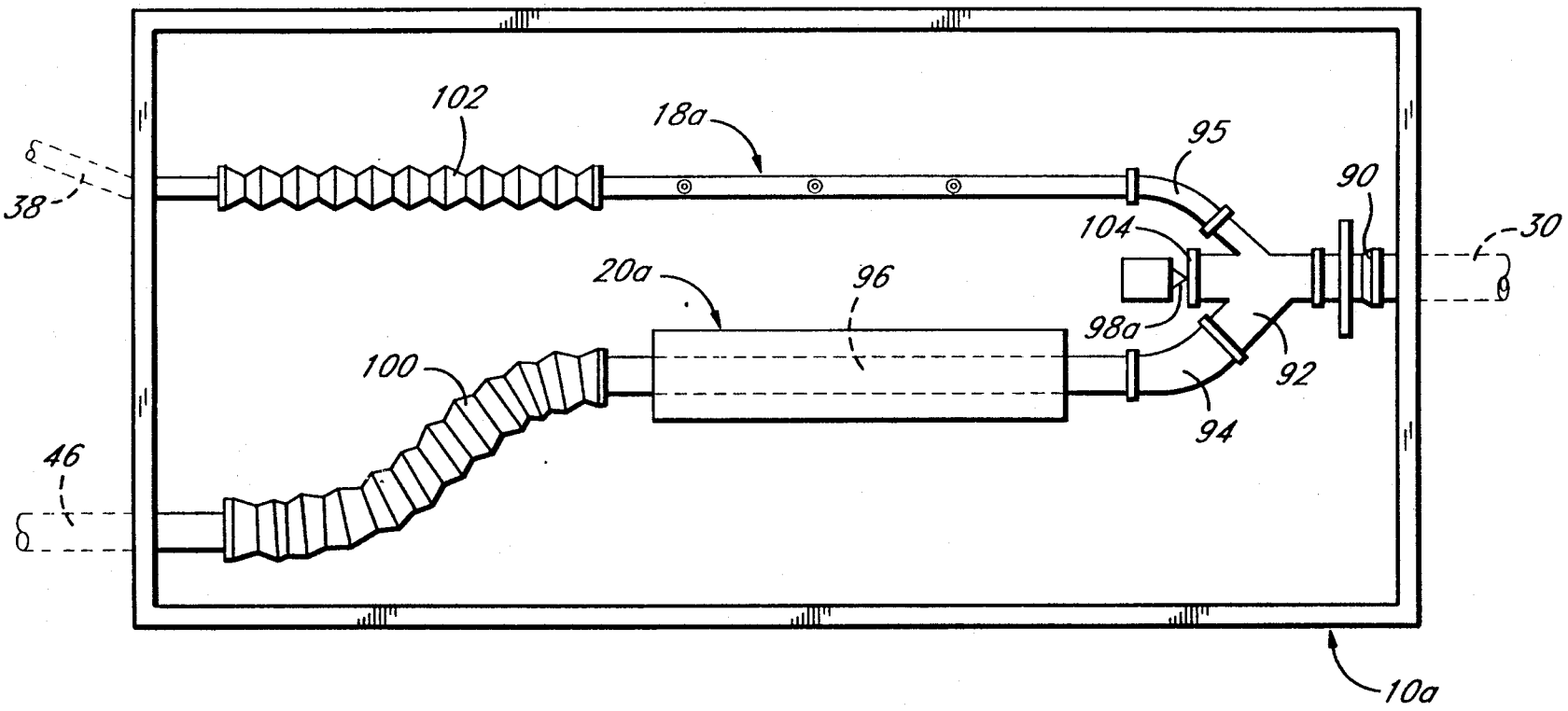
FIG. 6 is a top view of an alternate embodiment of the invention.

A second embodiment of the present invention is shown in FIG. 6. This embodiment comprises a diverter **10*a*. The diverter 10*a* comprises a swivel joint 90 which is connected to the inflow storm drain 30, a three-way pipe 92, a diverter section 18*a*, and a bypass section 20*a*. The three-way pipe 92 is connected to the swivel joint 90 such that it is allowed to turn around its axis with respect to the inflow pipe 30. Two elbow pipes 94 and 95 are connected to the outlets of the three-way pipe 92. Stability is provided by a fulcrum pivot 98*a* which rests against an end plate 104 on the center outlet of the three-way pipe 92. The diverter section 18***a* is connected to the outlet of the elbow pipe 95 and a bypass section 20*a* which is connected to the outlet of the elbow pipe 94. The diverter section 18*a* is connected at the other end to the outflow pipe 38 by a flexible connector 102 and the bypass section 20*a* is connected at the other end to the bypass line 46 by a flexible connector 100. This embodiment has only one tank 96 over the bypass section 20*a*, and each of the outlet sections 18 and 20 comprises a single rigid pipe.

The operation of this embodiment is essentially the same as described in the preferred embodiment except that the swivel joint 90 is used to cause the diverter 10*a* to change operational states rather than the pulley system 24. The swivel joint 90 forces one pipe to swing upwardly when the other is being forced downwardly by either the dead weights or by the weight of the water in the tank 96. The flexible connectors 100 and 102 are of sufficient length to span the distance between the outlet section 18*a* or 20*a* and its respective outlet pipe 38 or 46 whether it is in the up or down position.

In order to change the ratio of bed load to water discharge during peak flood flow, the lengths of the outlets of the three-way pipe 92 must be changed. Thus, in cases where it is important to change this ratio, it is preferable to use the initially discussed embodiment in which the ratio can be more easily altered by changing the length of the cable 78.

Figure 7:
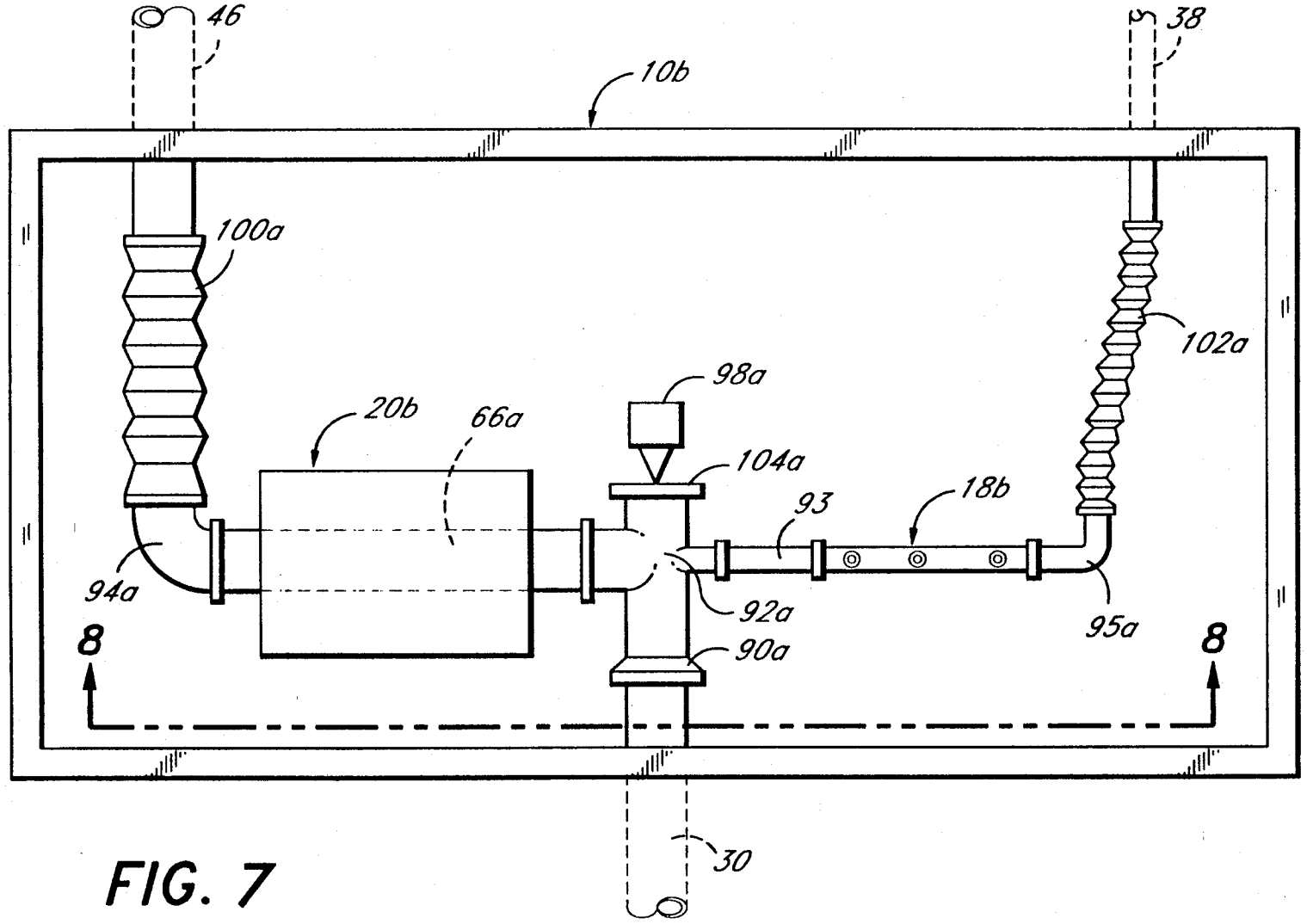
FIG. 7 is a top view of another alternate embodiment of the invention.
Figure 8:
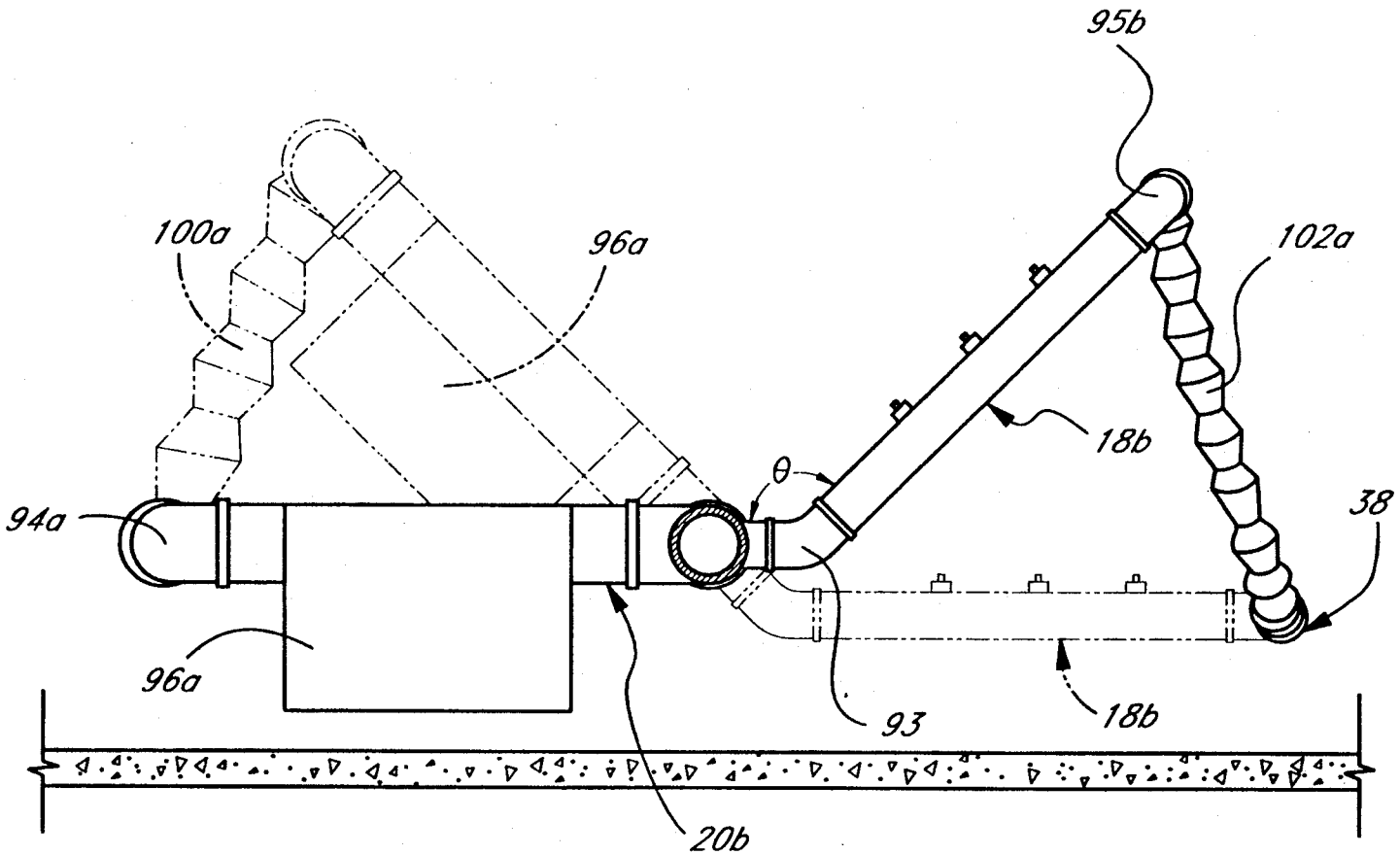
FIG. 8 is a sectional view taken along lines 8—8 of FIG. 7 showing the two operational states of the invention.

A third embodiment of the invention, shown in FIGS. 7 and 8, comprises a hydraulic oscillating diverter 10*b*. The diverter 10*b* comprises a swivel joint 90*a*, a 3-way pipe 92*a*, and diverter outlet section 18*b*, and a bypass outlet section 20*b*. The outlet sections 18*b* and 20*b* are both connected at 90 degrees to the inflow pipe 30 in the horizontal plane by means of the three-way pipe 92*a*. The outlet sections 18*b* and 20*b* are also oriented relative to one another in the vertical plane at an obtuse angle $\theta$ measuring around 135 degrees as shown in FIG. 8. This is accomplished by using an elbow pipe 93 to connect the diverter section 18*b* to the three-way pipe 92*a*. The elbow pipes 94*a* and 95*a* are connected to the other ends of outlet sections 18*b* and 20*b* and provide a 90 degree turn toward their respective outflow pipes 38 and 46.

In this embodiment, the swivel joint 90*a* and fulcrum pivot 98*a* form the center of a see-saw like structure. The operation is essentially the same as that of the second embodiment. The weight of either the dead weights or the water in the tank 96*a* produces a downward force on one of the outlet sections, causing the other to move upward at an angle $\theta$. The flexible couplings 100*a* and 102*a* are relatively long so that they can span the distance from the outlet sections 18*b* and 20*b* to their respective outlet pipes 38 and 46 when the outlet sections are in either of the up or down positions. In order to change the ratio of bed load to water discharge during peak flood flow, either the angle $\theta$ or the length of the diverter section 18*b* may be adjusted.

What is claimed is:

1. A hydraulic diverter for receiving water, including storm water comprising a first flush flow having a relatively high concentration of pollutants, and a sustained flow which is relatively free of pullutants, said diverter comprising an inlet, a first outlet section and a second outlet section, each of said outlet sections connected to receive storm water from said inlet for discharging storm water from said diverter, said diverter having two operational states and having means for utilizing energy of the storm water to change operational states, such that first flow is discharged through said first outlet section in a first operational state, and sustained flow is discharged through said second outlet section in a second operational state, wherein said water received by said diverter additionally comprises a nuisance flow having a relatively high concentration of pullutants, wherein said diverter is configured to discharge nuisance flow through said first outlet section in said first operational state, and wherein each of said outlet sections comprises an articulated tube, said articulated tubes being disposed in a guide block.

2. The diverter of claim 1, wherein said storm water additionally comprises a peak flow, and wherein peak flow is discharged through said first outlet section when said diverter is in said second operational state.

3. A hydraulic diverter for receiving water, including storm water comprising a first flush flow having a relatively high concentration of pollutants, said diverter comprising an inlet, a first outlet section and a second outlet section, each of said outlet sections connected to receive storm water from said inlet for discharging storm water from said diverter, said diverter having two operational states and having means for utilizing energy of the storm water to change operational states, such that first flush flow is discharged through said first outlet section in a first operational state, and sustained flow is discharged through said second outlet section in a second operational state, wherein said outlet sections are coupled together to change elevations relative to each other such that when one of said outlet sections is in a first elevational state, the other is in a second elevational state, and when the other of said outlet sections is in the first elevational state, the one of said sections is in the second elevational state.

4. The diverter of claim 3, wherein the outlet sections are coupled to relatively change elevations by a line connected to each of the outlet sections, said line being supported by a pulley.

5. The diverter of claim 3, wherein the outlet sections are coupled to relatively change elevations by a swivel which connects said outlet sections to the inlet.

6. The diverter of claim 3, wherein said outlet sections are substantially parallel to each other.

7. The diverter of claim 3, wherein one of said outlet sections comprises a container disposed to receive storm water when the flow per unit time of storm water reaches a threshold level to store energy of the storm water in the form of potential energy, the water in said container providing a force to cause said diverter to change from said first operational state to said second operational state when said potential energy reaches a threshold level.

8. The diverter of claim 7, wherein said container includes a drain for selectively draining the water from the container to allow said diverter to return to said first operational state.

9. The diverter of claim 7, wherein at least one of the outlet sections comprises an articulated tube.

10. The diverter of claim 9, wherein the articulated tube comprises a pair of rigid pipes joined by a flexible coupling.

11. The diverter of claim 7, wherein the other of the outlet sections comprises at least one removable weight disposed to counteract the potential energy of the storm water.

12. A storm water pollution control device, comprising:

an inlet for receiving storm water;

a first outlet section for discharging storm water having a relatively high concentration of pollutants;

a second outlet section for discharging storm water having a relatively low concentration of pollutants; and means for elevating (i) at least a portion of said second outlet section relative to said first outlet section to inhibit flow of storm water through said second section, and (ii) at least a portion of said first outlet section relative to said second outlet section to inhibit flow of storm water through said first outlet section.

13. The device of claim 12, wherein said elevating means comprises means for storing potential energy of the storm water.

14. The device of claim 12, wherein said elevating means comprises means for coupling said outlet sections together such that increasing the elevation of one outlet section decreases the elevation of the other outlet section.

15. The device of claim 14, wherein said coupling means comprises a rotatable fitting which connects said inlet to said outlet sections.

16. The device of claim 14, wherein said coupling means comprises a line and pulley.

17. The device of claim 12, wherein at least one of said outlet sections comprises an articulated tube, and wherein said elevating means causes at least one of the tubes to articulate.

18. A method of controlling runoff, comprising:

(a) introducing water into a diverter having first and second water paths;

(b) preferentially directing water through said first path during a first period of time;

(c) utilizing water introduced into said diverter during said first period of time to provide energy for controlling the flow of water through the diverter; and (d) utilizing said energy to alter the flow of water through the diverter for a second period of time such that at least a substantial portion of the water flows through said second path during said second period of time;

(e) performing step (d) during said runoff of water into said diverter only at a specific time which is between said first and second periods, said specific time being coincident with the time that the energy provided in step (c) becomes sufficient to perform the flow alteration in step (d).

19. The method of claim 18, wherein substantially all of the water introduced into said diverter flows through said first path during substantially all of said first period of time.

20. The method of claim 19, wherein said step of utilizing water to provide said energy comprises storing water to provide potential energy.

21. The method of claim 20, wherein said step of utilizing said energy occurs only after the stored water provides a threshold amount of potential energy.

22. The method of claim 18, additionally comprising the step of directing said water through both of said storm water paths during a third period of time.

23. The method of claim 22, additionally comprising the step of directing water flowing through the first path during the third period of time to a basin, and directing water flowing through the second path during said third period of time to an outflow line.

24. The method of claim 23, additionally comprising the step of discharging water from said basin to said outflow line during a fourth period of time.

25. A method of controlling storm water, comprising:

directing relatively low flows of storm water along a first path from an inlet to a first outlet and thence to a basin;

directing relatively high flows of storm water along a second path from said inlet to a second outlet and thence to an outflow drain; and controlling the flow of storm water to said basin and outflow drain by changing the relative elevations of said first and second paths.

26. A hydraulic diverter for controlling runoff, comprising:

a first tube which provides a first path for water received by said diverter;

a second tube which provides a first path for water received by said diverter;

a second tube which provides a second path for water received by said diverter; and flow control means for (1) preferentially directing water through said first path during a first period of time, (ii) storing water introduced into said diverter during said first period of time to provide energy for controlling the flow of water through the diverter, and (iii) utilizing said energy in the stored water to directly produce a mechanical force without conversion to electrical energy; (iv) applying said mechanical force to said diverter to alter the flow of water through the diverter, such that at least a substantial portion of the water flows through the second path during a second period of time.

27. The diverter of claim 26, additionally comprising means for adjusting said flow control means to control the time at which said flow is altered.

28. The diverter of claim 27, wherein the time adjusting means comprises a line connected between said tubes.

29. The diver of claim 26, additionally comprising means for adjusting said flow control means to control the amount of energy required to alter said flow of water.

30. The diverter of claim 29, wherein said energy adjusting means comprises a removable weight attached to said first tube.

31. The diverter of claim 26 wherein said tubes comprise articulated tubes.

32. A drainage control system having a water retention/detention basin and a storm drain, said system comprising:

means for diverting first flush flow produced by a storm from said storm drain to said basin;

means for diverting sustained flow produced by said storm from said storm drain to an outflow drain line, such that said sustained flow bypasses said basin;

means for conveying coarse sediment from said storm drain to the outflow drain;

means for diverting peak flow produced by said storm to said basin for storage; and means for discharging the peak flow water stored in said basin into said outflow line.

33. The system of claim 32, further comprising means for directing nuisance flow from said storm drain into said basin.

* * * * *